US011857084B2

(12) United States Patent
Piretti

(10) Patent No.: US 11,857,084 B2
(45) Date of Patent: Jan. 2, 2024

(54) CHAIR WITH PIVOTING SEAT AND BACKREST

(71) Applicant: Pro-Cord S.p.A., Bologna (IT)

(72) Inventor: Giancarlo Piretti, Bologna (IT)

(73) Assignee: Pro-Cord S.p.A., Bologna (IT)

( * ) Notice: Subject to any disclaimer, the term of this patent is extended or adjusted under 35 U.S.C. 154(b) by 0 days.

(21) Appl. No.: 17/696,939

(22) Filed: Mar. 17, 2022

(65) Prior Publication Data

US 2022/0295996 A1 Sep. 22, 2022

(30) Foreign Application Priority Data

Mar. 18, 2021 (IT) ..... 102021000006467

(51) Int. Cl.
*A47C 7/44* (2006.01)

(52) U.S. Cl.
CPC ..... *A47C 7/44* (2013.01)

(58) Field of Classification Search
CPC ..... A47C 7/44; A47C 4/02
USPC ..... 297/440.21, 440.22, 446.1, 447.4, 448.2, 297/285, 296
See application file for complete search history.

(56) References Cited

U.S. PATENT DOCUMENTS 2,135,833 A * 11/1938 Oermann ..... A47C 3/021 297/287
3,275,371 A * 9/1966 Rowland ..... A47C 1/124 297/446.1 X
3,278,227 A * 10/1966 Rowland ..... A47C 1/124 297/239
3,724,897 A * 4/1973 Faiks ..... A47C 1/124 297/448.2 X
3,847,433 A * 11/1974 Acton ..... A47C 5/04 D6/373
3,999,802 A * 12/1976 Powers ..... A47C 5/046 297/448.2 X
4,305,617 A * 12/1981 Benoit ..... A47C 5/06 297/440.21
4,522,444 A * 6/1985 Pollock ..... A47C 3/021 297/452.13 X
4,548,441 A * 10/1985 Ogg ..... A47C 3/04 297/448.2 X
4,618,185 A * 10/1986 Kaufman ..... A47C 4/02 297/285

(Continued)

FOREIGN PATENT DOCUMENTS

KR 200263326 Y1 2/2002
KR 20120042565 A 5/2012

(Continued)

OTHER PUBLICATIONS

Italian Search Report and Opinion dated Nov. 16, 2021. 8 pages.

*Primary Examiner* — Rodney B White
(74) *Attorney, Agent, or Firm* — RMCK Law Group PLC

(57) ABSTRACT

A chair includes a frame having a front transverse element defining a first hinging axis and a rear transverse element defining a second hinging axis; a seat having a front section hinged with the frame about the first hinging axis; and a backrest hinged with the frame about the second hinging axis, wherein the backrest includes a backrest support having a bottom transverse element defining a third hinging axis, and wherein the backrest support is hinged with a rear section of the seat about the third hinging axis.

7 Claims, 9 Drawing Sheets

(56) References Cited

U.S. PATENT DOCUMENTS 4,648,653 A * 3/1987 Rowland ..... A47C 3/04 297/239
4,787,672 A * 11/1988 Werner ..... A47C 3/021 297/296
4,880,272 A * 11/1989 Brauning ..... A47C 7/445 297/296
5,123,702 A * 6/1992 Caruso ..... A47C 3/12 297/448.2 X
5,383,712 A * 1/1995 Perry ..... A47C 7/44 297/448.2 X
5,626,394 A * 5/1997 Perry ..... A47C 3/04 297/448.2 X
5,806,931 A * 9/1998 Kogai ..... A47C 7/445 297/452.2
5,820,221 A * 10/1998 Greaves ..... A47C 4/04 297/440.22
5,823,626 A * 10/1998 Haas ..... A47C 1/03277 297/448.2 X
5,924,770 A * 7/1999 Tarnay ..... A47C 5/12 297/446.1 X
RE36,335 E * 10/1999 Perry ..... A47C 3/023 297/448.2 X
5,961,184 A * 10/1999 Balderi ..... A47C 5/06 297/440.21 X
6,003,948 A * 12/1999 Holbrook ..... A47C 3/12 297/448.2
6,056,361 A * 5/2000 Cvek ..... A47C 1/03272 297/448.2 X
6,109,696 A * 8/2000 Newhouse ..... A47C 7/42 297/448.2 X
6,135,562 A * 10/2000 Infanti ..... A47C 13/005 297/440.22
6,149,240 A * 11/2000 Pietrzak ..... A47C 7/16 297/440.22
6,224,159 B1 * 5/2001 Perry ..... A47C 7/44 297/448.2 X
6,722,735 B2 * 4/2004 Lucci ..... A47C 3/12 297/320
6,837,539 B1 * 1/2005 Casey ..... A47C 7/70 297/448.2
7,073,864 B2 * 7/2006 Olsen ..... A47C 3/04 297/448.2 X
7,111,906 B2 * 9/2006 Heisey ..... A47C 7/22 297/448.2 X
7,568,765 B2 * 8/2009 Brauning ..... A47C 7/38 297/452.13 X
7,681,956 B2 * 3/2010 Huang ..... A47C 4/03 297/448.2 X
7,775,600 B2 * 8/2010 Battey ..... A47C 7/32 297/440.21 X
7,971,935 B2 * 7/2011 Saez ..... A47C 7/405 297/446.1 X
8,096,621 B2 * 1/2012 Braun ..... B60N 2/682 297/440.16
8,465,095 B2 * 6/2013 Su ..... A47C 7/44 297/301.1
9,055,817 B2 * 6/2015 Weber ..... A47C 3/023
9,107,504 B2 * 8/2015 Haas ..... A47C 3/021
9,364,092 B2 * 6/2016 Piretti ..... A47C 7/44
9,504,326 B1 * 11/2016 Cartis ..... A47C 3/04
9,706,847 B2 * 7/2017 Piretti ..... A47C 5/04
9,826,838 B2 * 11/2017 Piretti ..... A47C 7/002
10,028,586 B2 * 7/2018 Schneider ..... A47C 1/03238
10,058,185 B2 * 8/2018 Naik ..... A47C 7/006
10,799,028 B2 * 10/2020 Deisig ..... A47C 7/443
11,140,989 B2 * 10/2021 Kumazawa ..... A47C 5/12
11,147,379 B2 * 10/2021 Smith ..... A47C 4/06
11,197,552 B2 * 12/2021 Piretti ..... A47C 7/445
11,266,244 B2 * 3/2022 Barrett ..... A47C 1/024
11,382,429 B2 * 7/2022 Kumazawa ..... A47C 7/46
2003/0090139 A1 * 5/2003 Kown ..... A47C 3/023 297/446.2
2010/0244515 A1 * 9/2010 Ivicevic ..... A47C 1/03272 297/239
2012/0153700 A1 * 6/2012 Weber ..... A47C 3/023 297/445.1
2013/0001994 A1 * 1/2013 Wu ..... A47C 7/443 297/285
2014/0183915 A1 * 7/2014 Deisig ..... A47C 3/045 297/285
2020/0085194 A1 * 3/2020 Maier ..... A47C 1/03261

FOREIGN PATENT DOCUMENTS

KR 20120118575 A * 10/2012 ..... A47C 7/44
KR 1591947 B1 * 2/2016 ..... A47C 7/44
WO 2007023301 A1 3/2007
WO WO-2008064886 A1 * 6/2008 ..... A47C 5/04

* cited by examiner

CHAIR WITH PIVOTING SEAT AND BACKREST

CROSS-REFERENCE TO RELATED APPLICATION

This application claims priority to Italian Patent Application No. 102021000006467 filed Mar. 18, 2021. The disclosure of the above application is incorporated herein by reference in its entirety.

FIELD OF THE INVENTION

The present invention relates to a chair with pivoting seat and backrest.

More precisely, the invention relates to a chair wherein the seat and the backrest are hinged about respective transverse axes and wherein the backwards inclination movement of the backrest is coordinated with an upwards pivoting movement of the rear part of the seat.

PRIOR ART

In the present state of the art many chairs provided with a mechanism which allows synchronization of the backwards inclination movement of the backrest and the pivoting movement of the seat in order to make the chair comfortable and ergonomic are known.

In the present state of the art chairs provided with so-called weight-activated mechanisms are also known, where the backwards pivoting movement of the backrest results in a simultaneous raising movement of the seat, so that the resistance to the backwards inclination of the backrest is related to the weight of the user.

The mechanisms which are able to provide a synchronized pivoting movement of the seat and the backrest are usually complex, bulky and costly and require lever mechanisms for the relative synchronization of the seat and backrest movements. Generally, the mechanisms of the known type require elastic elements in order to provide a reaction force which opposes the backwards thrust imparted to the backrest by the user's back.

The mechanisms for synchronized pivoting of the seat and backrest involve a substantial increase in the complexity of the chair and, owing to their volume, result in constraints which make it difficult to achieve a simple and linear design.

OBJECT AND SUMMARY OF THE INVENTION

The object of the present invention is to provide a chair with pivoting seat and backrest which overcomes the problems of the prior art.

More precisely, the object of the invention is to provide a chair with a weight-activated pivoting mechanism, which has an extremely simple structure and does not have bulky dimensions which limit the freedom of the designer.

According to the present invention, these objects are achieved by a chair having the features forming the subject of claim 1.

Optional features of the chair according to the invention form the subject of the dependent claims.

As will become clear from the description below, the chair according to the present invention performs a backward pivoting movement of the backrest and a simultaneous raising movement of the rear part of the seat so that the reaction to the backwards inclination movement of the backrest is proportional to the weight of the user. The chair according to the present invention is entirely without elastic elements for providing a reaction force in response to the backwards inclination movement and the return movement into the rest configuration. As will become clear below, the chair according to the present invention makes use of the elastic deformation of the frame in order to allow a relative movement of the hinging axes of the seat and the backrest during the movement from the rest position into the backwards inclined position and vice versa.

BRIEF DESCRIPTION OF THE DRAWINGS

The present invention will now be described in detail with reference to the accompanying drawings provided purely by way of a non-limiting example in which.

DETAILED DESCRIPTION

Figure 1:
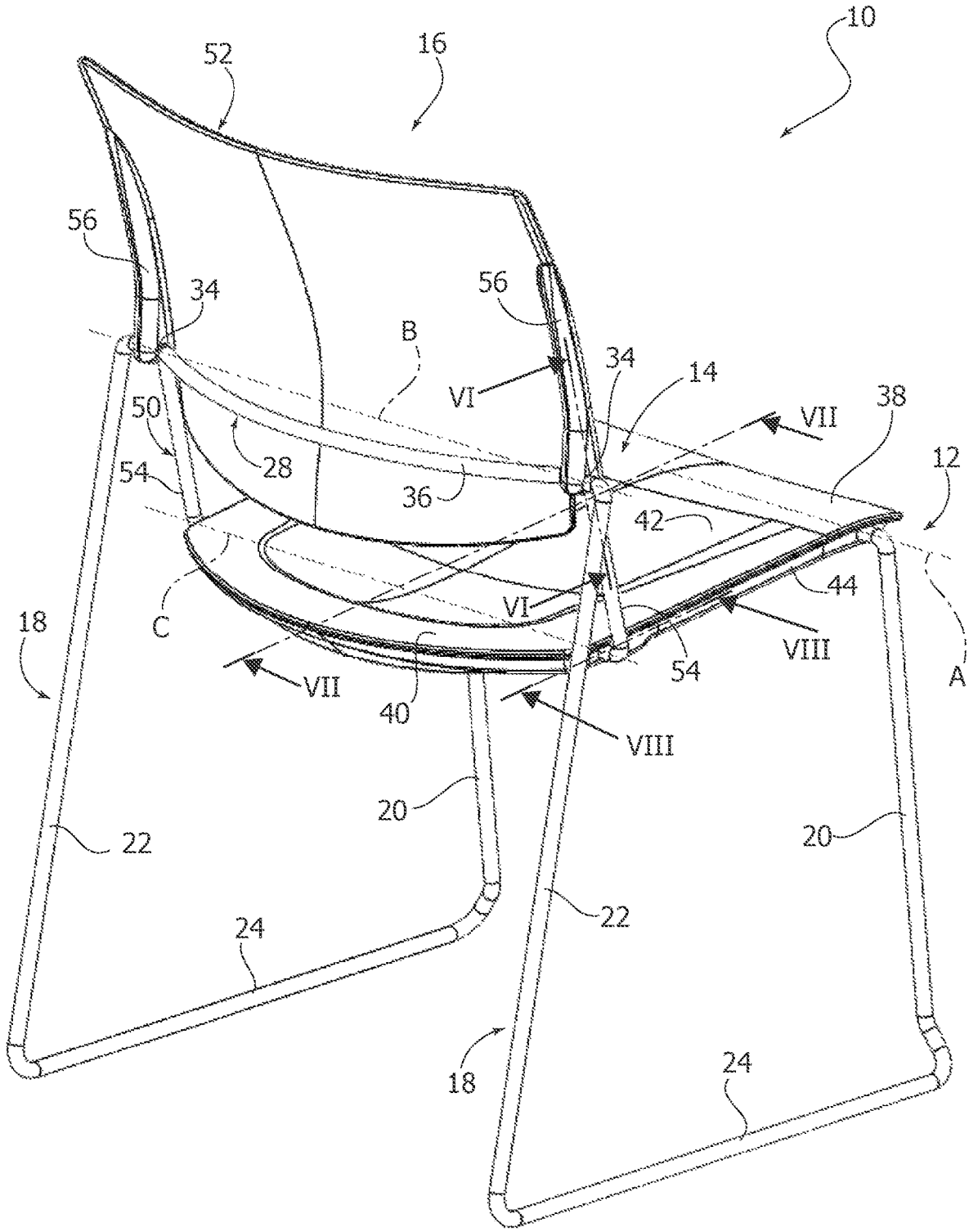
FIG. 1 is a perspective view of a chair according to the invention.

With reference to FIGS. 1-5, 10 denotes a chair with pivoting seat and backrest. The chair 10 comprises a frame 12, a seat 14 and a backrest 16.

The frame 12 may be formed by a plurality of metal bars consisting of solid or tubular rods which are folded and fixed together. In one possible embodiment the frame comprises two frame side sections 18, each of which comprises a front leg 20, a rear leg 22 and a bottom element 24 which connects together the bottom ends of the front leg 20 and the rear leg 22.

Figure 2:
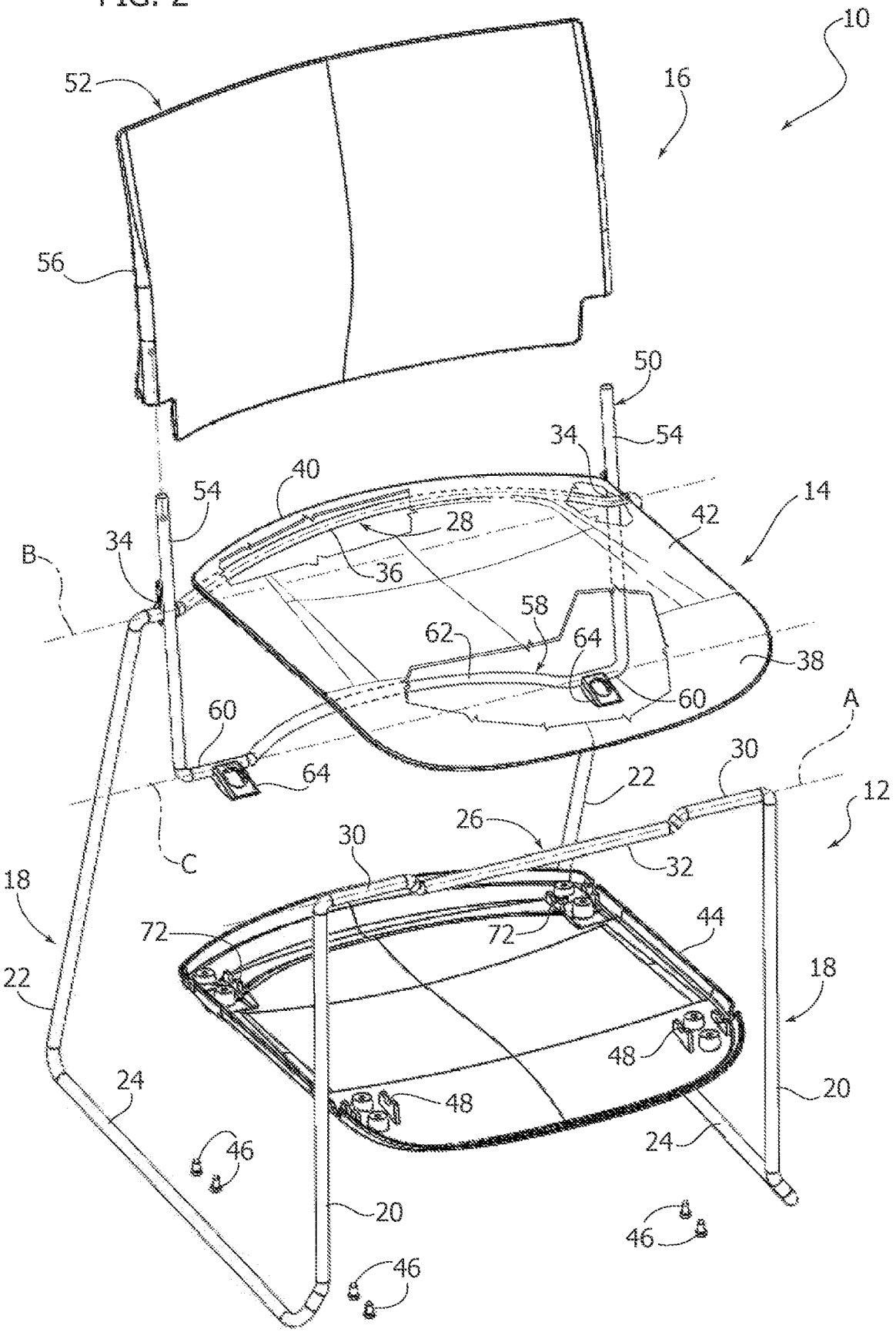
FIG. 2 is an exploded perspective view of the chair shown in FIG. 1.

With reference in particular to FIG. 2, the two frame sections 18 are connected together by a front transverse element 26 and by a rear transverse element 28. The front transverse element 26 connects together the top ends of the two front legs 20 and the rear transverse element 28 connects together the top ends of the two rear legs 22. The rear transverse element 28 is situated at a greater height than the height of the front transverse element 26.

The front transverse element 26 comprises two side sections 30 and a central section 32. The two side sections 30 are aligned with each other along a horizontal transverse line which defines a first hinging axis A.

The rear transverse element 28 comprises two straight side sections 34 joined together by a curved central section 36. The two side sections 34 of the rear transverse element 28 are aligned with each other along a horizontal transverse line which defines a second hinging axis B. The second hinging axis B is parallel to the first hinging axis A and is displaced backwards and upwards with respect to the first hinging axis A.

With reference to FIGS. 1-5, the seat 14 has a front section 38 and a rear section 40. The front section 38 of the seat 14 is hinged with the frame 12 about the first hinging axis A. In one possible embodiment, the seat 14 may be formed by an upper panel 42 and by a lower panel 44 which are fixed together by means of screws 46. The upper panel 42 and the lower panel 44 of the seat 14 are situated on opposite sides of the front transverse element 26 and enclose the front transverse element 26 inside the front section 38 of the seat 14. At least one of the panels 40, 42 may be provided with hinging seats 48 (FIG. 2) which cooperate with the respective side sections 30 of the front transverse element 26 so as to form a hinged connection between the front section 38 of the seat 14 and the front transverse element 26 which allows the seat 14 to pivot about the first hinging axis A. Obviously it is understood that the hinged connection between the front section 38 of the seat 14 and front transverse element 26 of the frame 12 may be realized in any other way.

With reference to FIGS. 1-6, the backrest 16 comprises a backrest support 50 and a backrest panel 52 which is fixed to the backrest support 50. The backrest panel 52 may be made of moulded plastic material and may have a curved surface for supporting the user's back. The curved central section 36 of the rear transverse element 28 extends behind the backrest panel 52.

The backrest support 50 may be formed by folded metal elements which are substantially U-shaped. With reference in particular to FIG. 2, the backrest support 50 may comprise two uprights 54 which are parallel to each other and to which the backrest panel 52 is fixed. The two uprights 54 of the backrest support 50 may have top ends which are inserted and fixed inside respective seats 56 of the backrest panel 52. The top ends of the uprights 54 may be inserted inside the seats 56 with slight interference.

With reference in particular to FIG. 2, the two uprights 54 of the backrest support 50 are joined together by a bottom transverse element 58 having two straight side sections 60 which are joined together by a curved central section 62. The two straight side sections 60 are aligned with each other along a horizontal transverse line which defines a third hinging axis C. The backrest support 50 may comprise two stop elements 64 which may be formed by two metal plates which are fixed to the respective straight side sections 60 of the bottom transverse element 58.

Figure 6:
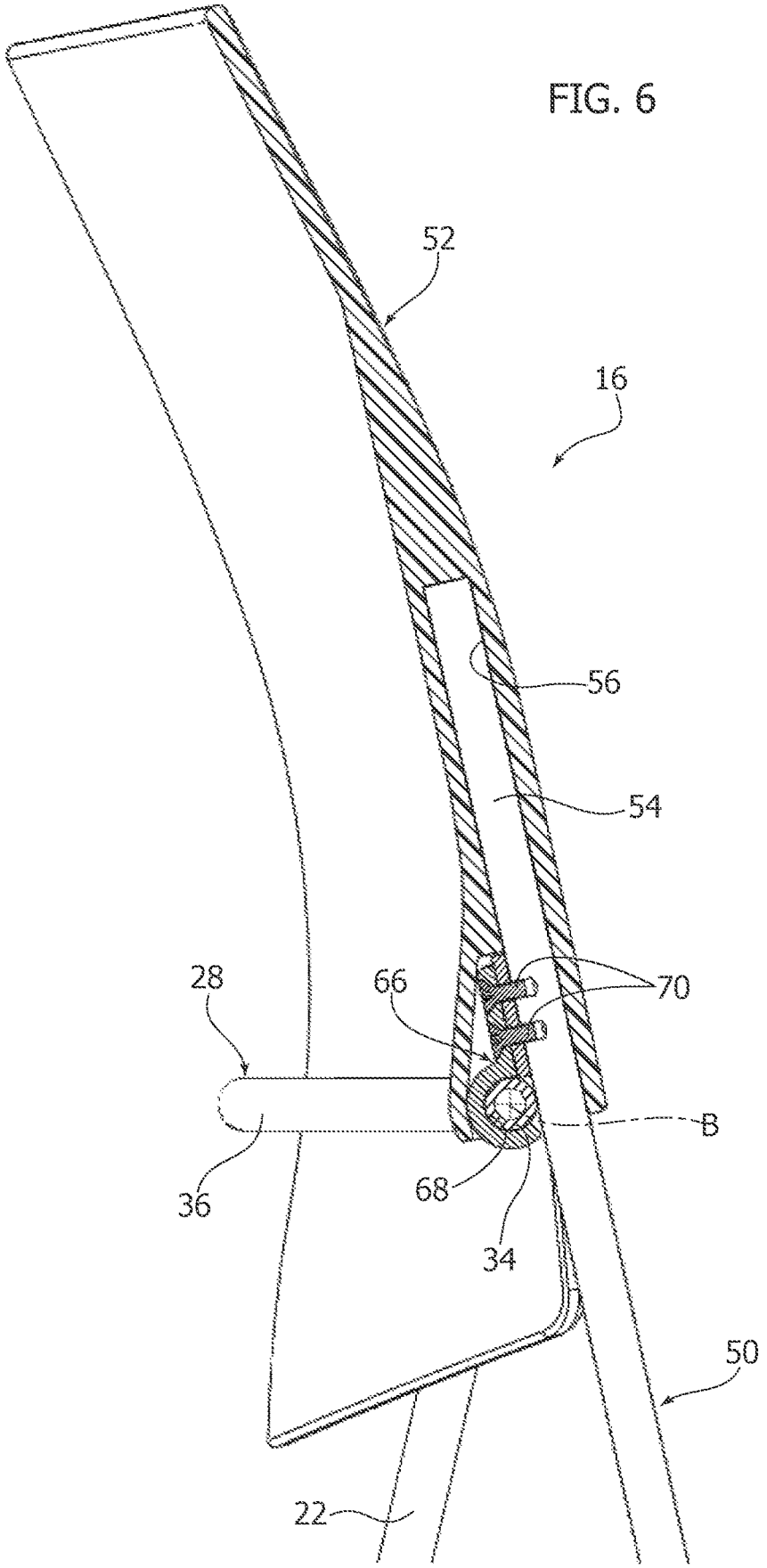
FIG. 6 is a cross-section on a larger scale along the line VI-VI of FIG. 1.

The backrest 16 is hinged with the rear transverse element 28 of the frame 12 about the second hinging axis B. With reference to FIG. 6, the hinged connection between the backrest 16 and the rear transverse element 28 may be realized by means of a pair of hinging plates 66 having respective circular seats 68 which engage rotatably with respective straight side sections 34 of the rear transverse element 28. Each of the two hinging plates 66 may be fixed to a respective upright 54 of the backrest support 50 by means of screws 70.

The backrest 16 is also hinged with the rear section 40 of the seat 14 about the third hinging axis C. In one possible embodiment, the hinged connection between the backrest 16 and the rear section 40 of the seat 14 may be realized by enclosing the straight side sections 60 of the bottom transverse element 58 of the backrest support 50 between the upper panel 42 and the lower panel 44 of the seat 14 and by engaging these straight sections 60 by means of hinging seats 72 formed in at least one of the panels 42, 44.

The third hinging axis C which hingeably connects the backrest 16 to the rear section 40 of the seat 14 is situated lower and slightly further forwards in relation to the second hinging axis B. The third hinging axis C is situated displaced backwards with respect to the first hinging axis A. In the rest configuration shown in FIG. 3, the third hinging axis C may be lower than the first hinging axis A.

Figure 7:
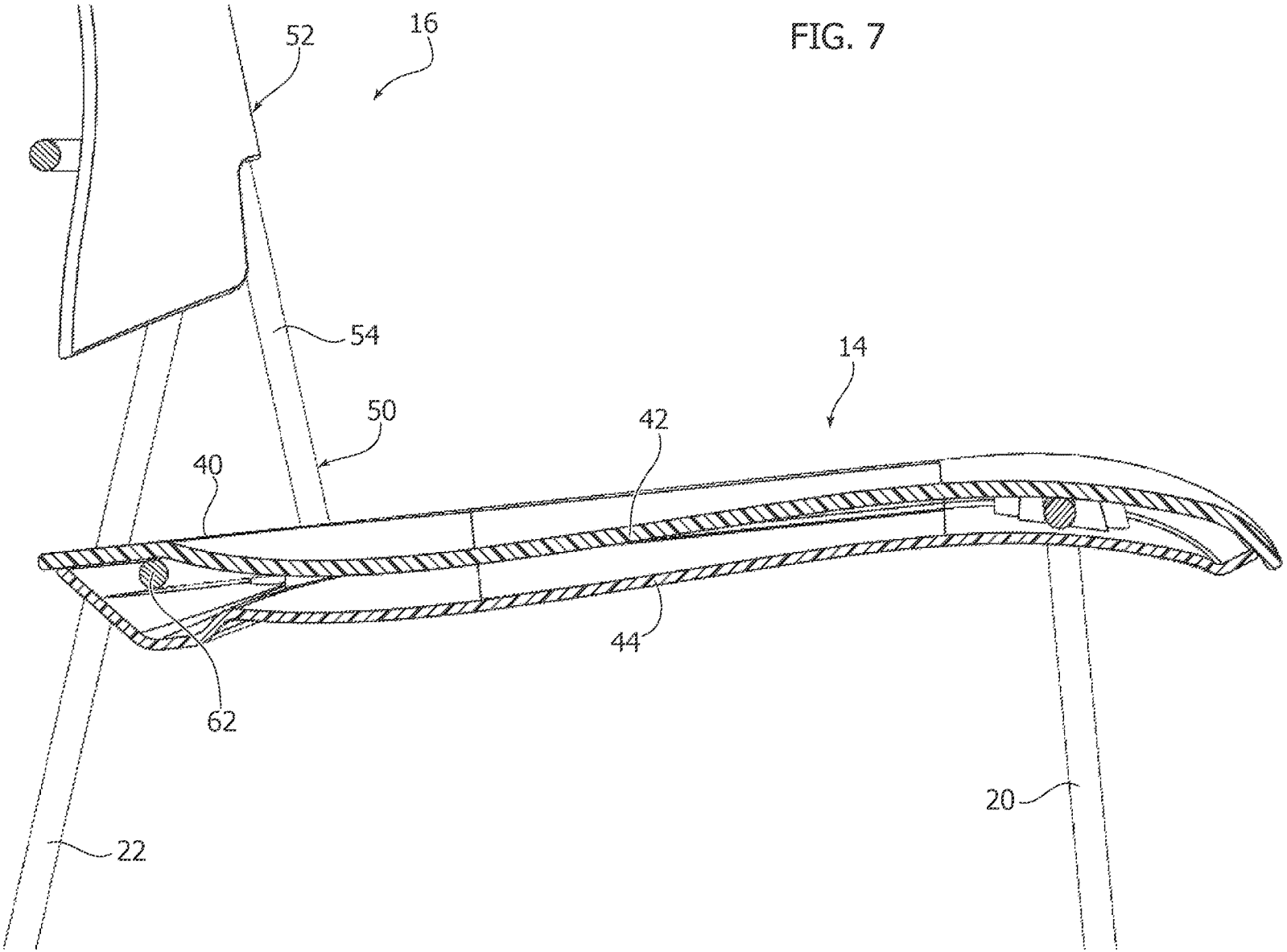
FIG. 7 is a cross-section along the line VII-VII of FIG. 1.

With reference to FIG. 7, the curved central section of the bottom transverse element 58 of the backrest support 50 is housed inside a chamber defined between the upper panel 42 and the lower panel 44 of the seat 14. In the rest position of the chair, the curved central section rests against the upper panel 42 of the seat 14 and forms an end-of-travel stop which prevents forwards pivoting of the backrest 16 with respect to the rest position.

Figure 5:
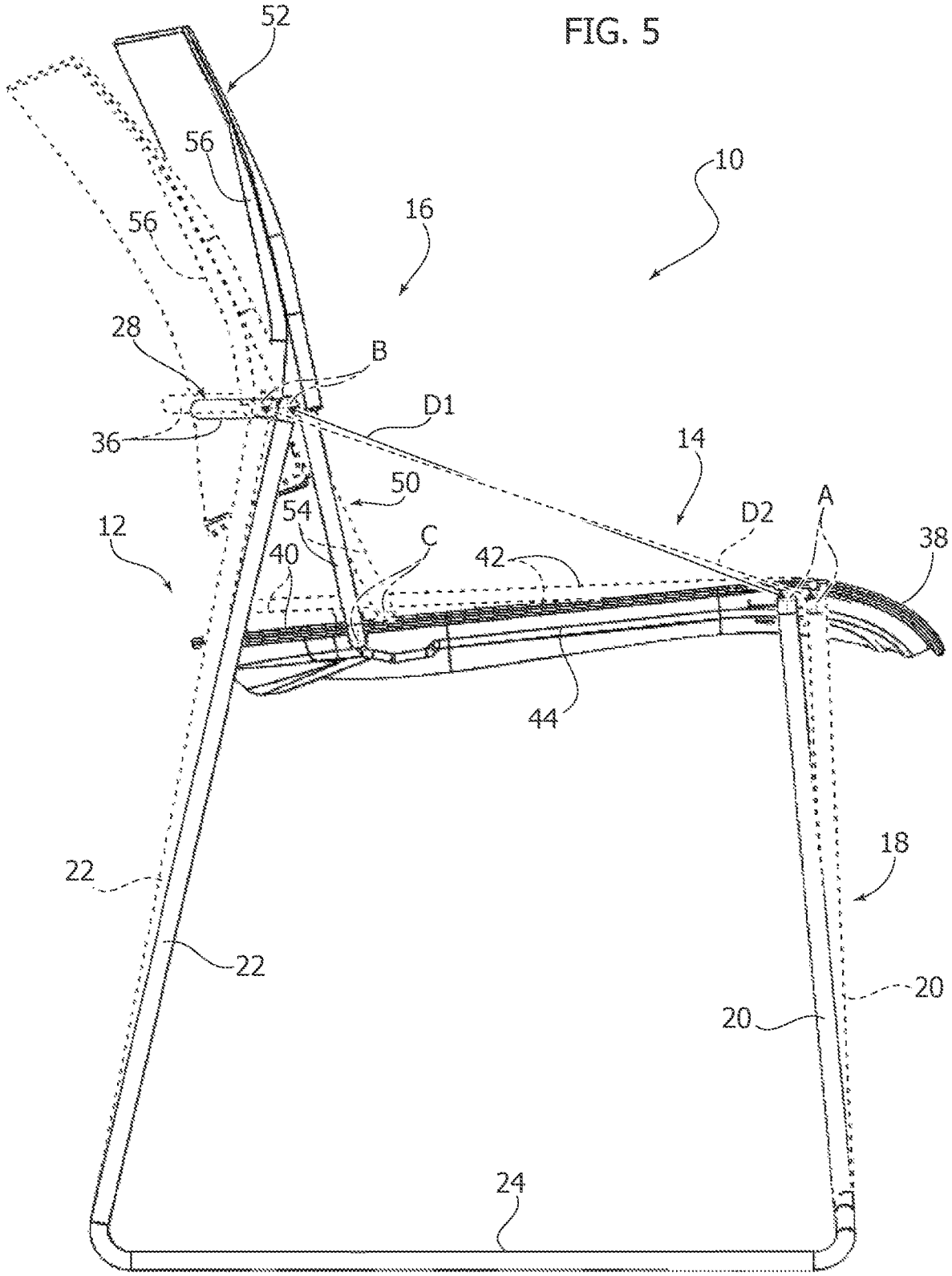
FIG. 5 is a schematic side view illustrating the movements of the seat, backrest and frame in the rest configuration and in the fully inclined backwards configuration.

When a user applies a backwards thrusting force onto the backrest 16, the backrest 16 pivots backwards about the second hinging axis B. The backwards pivoting of the backrest 16 causes a forwards and upwards movement of the bottom transverse element 58 of the backrest support 50. FIG. 5 shows by continuous solid lines the chair in the rest configuration and by broken lines the configuration of the chair in the condition where the backrest 16 is fully inclined backwards. The backwards inclination of the backrest 16 displaces the third hinging axis C forwards and upwards with respect to the rest configuration. Therefore, the rear section 40 of the seat 14 moves upwards with respect to the rest configuration and the seat 14 pivots about the first hinging axis A.

Figure 3:
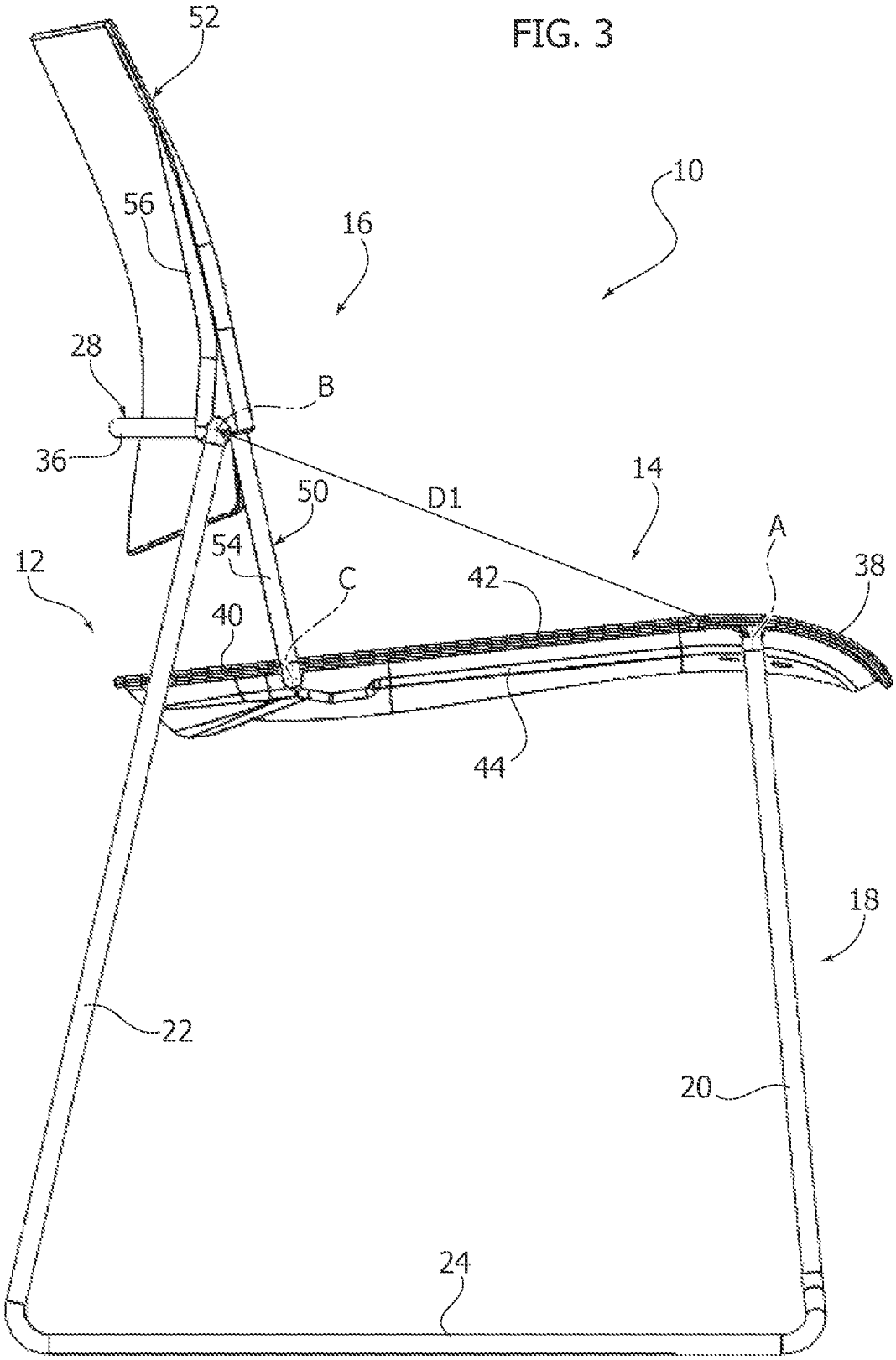
FIG. 3 is a side view of the chair according to FIG. 1 in the rest configuration.
Figure 4:
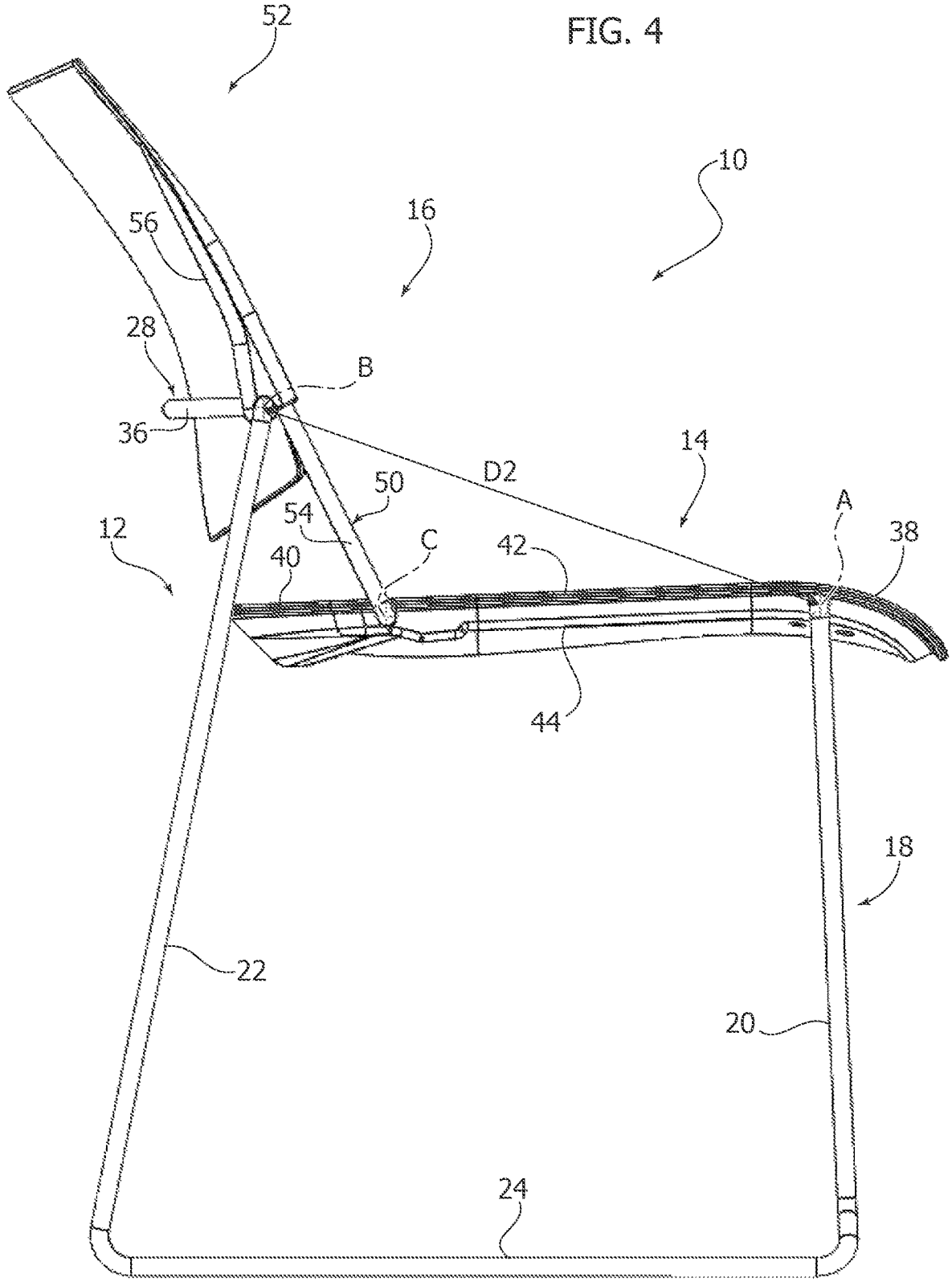
FIG. 4 is a side view showing the chair according to FIG. 2 in the position where it is fully inclined backwards.

As shown in FIGS. 3, 4 and 5, in the rest configuration the distance between the first hinging axis A and the second hinging axis B has a first value D1. The upwards and forwards movement of the second rotation axis C during the backwards pivoting movement of the backrest 16 results in a backwards displacement of the second hinging axis B and a forwards displacement of the first hinging axis A with respect to the rest configuration. In the configuration where the backrest 16 is fully inclined backwards, the distance between the first hinging axis A and the second hinging axis B has a second value D2 greater than the first value D1.

The increase in the distance between the first and second hinging axes A, B during the transition from the rest position into the backwards inclined position is possible owing to an elastic deformation of the frame 12. In particular, the top ends of the two front legs 20 are elastically deformed forwards so as to allow forwards displacement of the first hinging axis A and the top ends of the rear legs 22 are elastically deformed backwards so as to allow the backwards displacement of the second hinging axis B. When no more backwards thrust is applied to the backrest 16, the frame 12 returns into the undeformed rest configuration and the backrest 16 and the seat 14 return into the rest position.

The raising, during the backwards inclination of the backrest 16, of the rear section 40 of the seat 14 is such that the reaction to the backwards inclination of the backrest 16 is proportional to the user's weight, thus resulting in a pivoting mechanism of the seat and backrest which is of the weight-activated type, namely one where the reaction to the backwards inclination increases as the weight of the user increases.

Figure 8:
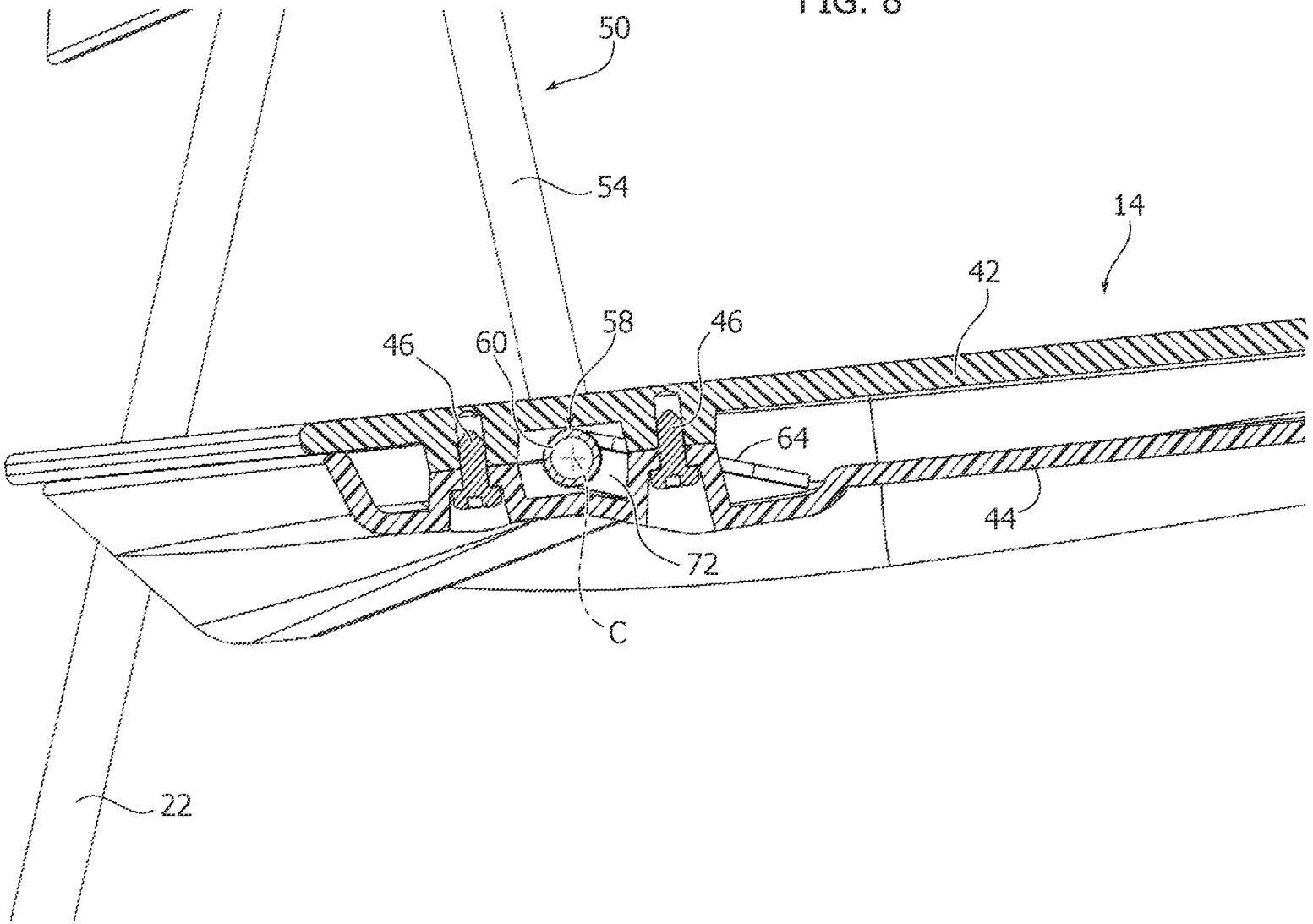
FIGS. 8 and 9 are cross-sections on a larger scale along the line VIII-VIII of FIG. 1, in the rest configuration and in the fully inclined backwards configuration, respectively.
Figure 9:
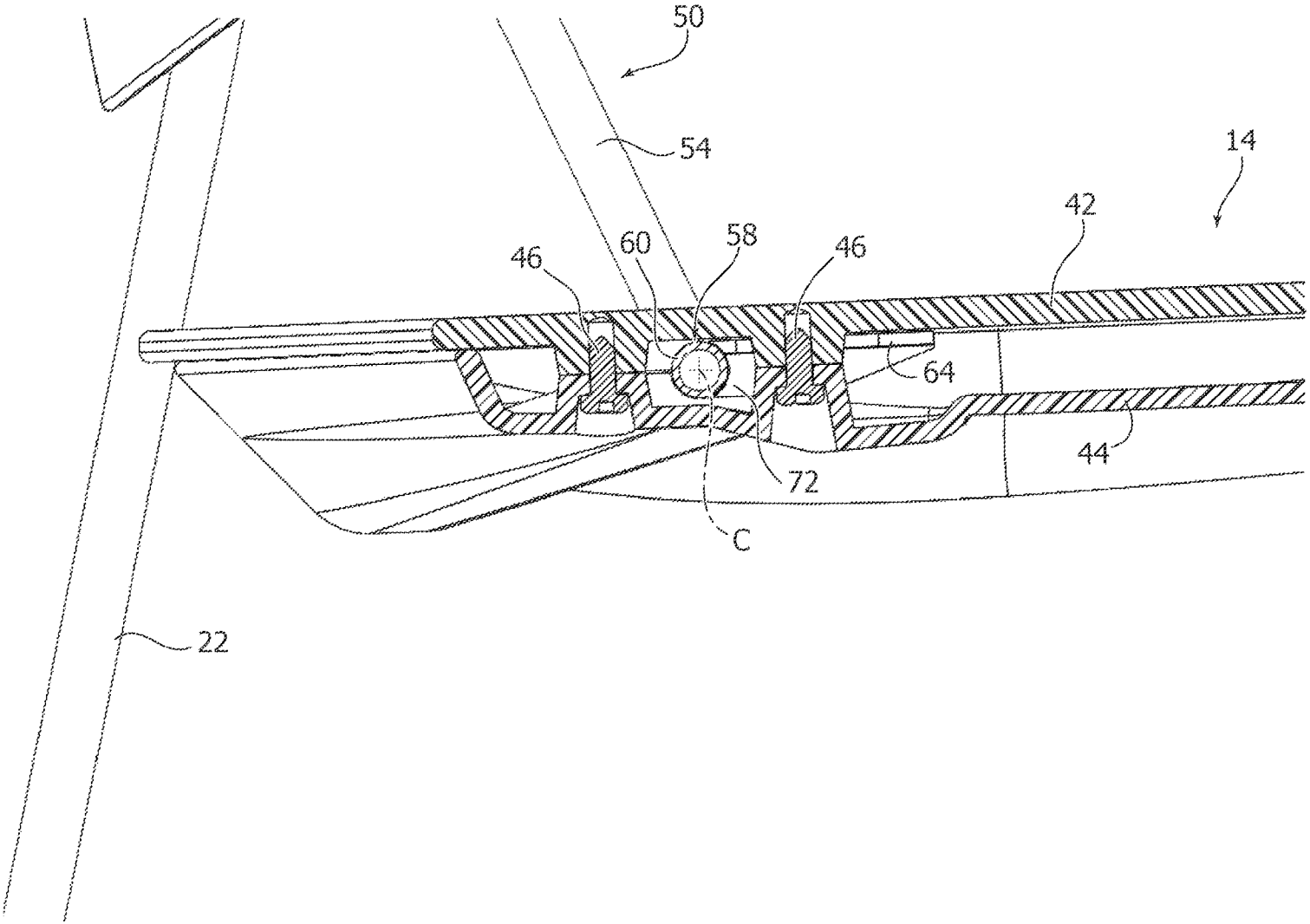

With reference to FIGS. 8 and 9, the stop elements fixed to the bottom transverse element 58 of the backrest support 50 move between the upper panel 42 and the lower panel 44 of the seat 14 during the backwards inclination movement of the backrest between the rest position (FIG. 8) and the fully inclined backwards position (FIG. 9). In the configuration shown in FIG. 9, the stop elements 64 come into contact with the upper panel 42 of the seat 14. In this condition, the stop elements 64 prevent a further backwards inclination movement of the backrest support 50 and therefore form an end-of-travel stop which defines the position of maximum backwards inclination of the backrest 16.

The chair according to the present invention provides a high degree of comfort owing to the synchronized movement of the backrest and the seat during the backwards inclination of the backrest. In particular, the upwards movement of the rear portion of the seat during the backwards inclination of the backrest prevents the backrest from sliding upwards with respect to the user's back during the backwards inclination of the backrest, which would result in an unpleasant sensation due to the sliding contact with the user's clothes. With the chair according to the present invention it is possible to obtain a weight-activated action in a very simple manner and without large dimensional volumes which would limit the designer's freedom when choosing the chair design. The chair according to the present invention does not comprise any elastic elements since the return movement of the backrest and the seat into the rest position when there is no longer any backwards thrust applied by the user's back is achieved by the intrinsic elasticity of the frame 12.

In possible embodiments, by adopting different proportions of the frame and the other components it is possible to provide an easy chair with the same operating and ergonomic characteristics.

Obviously, without altering the principle of the invention, the embodiments and the constructional details may be greatly varied with respect to that described and illustrated, without thereby departing from the scope of the invention as defined in the accompanying claims.

The invention claimed is:

1. A chair comprising:

a frame having a front transverse element defining a first hinging axis and a rear transverse element defining a second hinging axis, wherein the second hinging axis is situated further back in relation to the first hinging axis and at a greater height than the first hinging axis;

a seat having a front section and a rear section, wherein the front section of the seat is hinged with the frame about said first hinging axis;

a backrest including a backrest panel fixed to a backrest support, wherein the backrest is hinged with the frame about said second hinging axis, wherein the backrest support has a bottom transverse element defining a third hinging axis situated at a lower height than said second hinging axis, wherein said backrest support is hinged with said rear section of the seat about said third hinging axis;

wherein the backrest pivots about said second hinging axis between a rest position and a backwards inclined position, wherein in said rest position a distance between the first hinging axis and the second hinging axis has a first value and in said backwards inclined position a distance between the first hinging axis and the second hinging axis has a second value greater than said first value, and wherein the frame is deformable elastically so as to allow a variation of the distance between the first hinging axis and the second hinging axis between said first value and said second value;

wherein the backrest support has a general U shape and includes two uprights parallel to each other and fixed inside respective seats of the backrest panel, said uprights having respective bottom ends joined together by said bottom transverse element;

wherein said bottom transverse element of said backrest support has two straight side sections aligned with each other along a transverse line defining said third hinging axis and connected together by a curved central section; and wherein said curved central section of said bottom transverse element of the backrest support comes into contact with the seat in the rest position of the chair so as to define an end-of-travel stop which prevents a forward movement of the backrest in the rest position.

2. The chair of claim 1, wherein said backrest support comprises two stop elements fixed to the respective straight side sections of said bottom transverse element of the backrest support, wherein said stop elements come into contact with the seat in a fully backwards inclined position of the backrest and form an end-of-travel stop which prevents a further backwards inclination of the backrest in the fully backwards inclined position.

3. A chair comprising:

a frame having a front transverse element defining a first hinging axis and a rear transverse element defining a second hinging axis, wherein the second hinging axis is situated further back in relation to the first hinging axis and at a greater height than the first hinging axis;

a seat having a front section and a rear section, wherein the front section of the seat is hinged with the frame about said first hinging axis; and a backrest including a backrest panel fixed to a backrest support, wherein the backrest is hinged with the frame about said second hinging axis, wherein the backrest support has a bottom transverse element defining a third hinging axis situated at a lower height than said second hinging axis, wherein said backrest support is hinged with said rear section of the seat about said third hinging axis;

wherein the backrest pivots about said second hinging axis between a rest position and a backwards inclined position, wherein in said rest position a distance between the first hinging axis and the second hinging axis has a first value and in said backwards inclined position a distance between the first hinging axis and the second hinging axis has a second value greater than said first value, and wherein the frame is deformable elastically so as to allow a variation of the distance between the first hinging axis and the second hinging axis between said first value and said second value;

wherein the backrest support has a general U shape and includes two uprights parallel to each other and fixed inside respective seats of the backrest panel, said uprights having respective bottom ends joined together by said bottom transverse element;

wherein said bottom transverse element of said backrest support has two straight side sections aligned with each other along a transverse line defining said third hinging axis and connected together by a curved central section; and wherein said seat comprises an upper panel and a lower panel which are fixed together, wherein the upper panel and the lower panel enclose between them said front transverse element of the frame and said bottom transverse element of the backrest support and form a hinged connection between the front section of the seat and said front transverse element and between the rear section of the seat and said bottom transverse element of the backrest support.

4. The chair of claim 3, wherein at least one of said upper and lower panels is provided with hinging seats configured to hingeably connect the seat together with said front transverse element and said bottom transverse element.

5. The chair of claim 1, wherein said front transverse element extends between top ends of a pair of front legs of the frame and wherein said rear transverse element extends between top ends of a pair of rear legs of the frame.

6. The chair of claim 1, wherein the frame comprises two side frame sections which are identical to each other and each of which comprises a front leg, a rear leg and a bottom element which connects together the bottom ends of the front leg and the rear leg.

7. A chair comprising:

a frame having a front transverse element defining a first hinging axis and a rear transverse element defining a second hinging axis, wherein the second hinging axis is situated further back in relation to the first hinging axis and at a greater height than the first hinging axis;

a seat having a front section and a rear section, wherein the front section of the seat is hinged with the frame about said first hinging axis; and a backrest including a backrest panel fixed to a backrest support, wherein the backrest is hinged with the frame about said second hinging axis, wherein the backrest support has a bottom transverse element defining a third hinging axis situated at a lower height than said second hinging axis, wherein said backrest support is hinged with said rear section of the seat about said third hinging axis;

wherein the backrest pivots about said second hinging axis between a rest position and a backwards inclined position wherein in said rest position a distance between the first hinging axis and the second hinging axis has a first value and in said backwards inclined position a distance between the first hinging axis and the second hinging axis has a second value greater than said first value, and wherein the frame is deformable elastically so as to allow a variation of the distance between the first hinging axis and the second hinging axis between said first value and said second value;

wherein the backrest support has a general U shape and includes two uprights parallel to each other and fixed inside respective seats of the backrest panel, said uprights having respective bottom ends joined together by said bottom transverse element;

wherein said bottom transverse element of said backrest support has two straight side sections aligned with each other along a transverse line defining said third hinging axis and connected together by a curved central section; and wherein the backrest is hinged with said rear transverse element by a pair of hinging plates having respective circular seats which rotatably engage with respective straight side sections of the rear transverse element, and wherein each of the hinging plates is fixed to a respective upright of the backrest support by screws.

* * * * *